US005606903A

United States Patent [19]

Drittel

[11] Patent Number: 5,606,903

[45] Date of Patent: Mar. 4, 1997

[54] RODLESS PRESSURE CYLINDER

[75] Inventor: Volker Drittel, Renningen, Germany

[73] Assignee: Hygrama AG, Rotkreuz, Switzerland

[21] Appl. No.: 565,244

[22] Filed: Nov. 30, 1995

[30] Foreign Application Priority Data

Nov. 30, 1994 [AT] Austria ..... 2219/94

[51] Int. Cl.[6] ..... F01B 29/08

[52] U.S. Cl. ..... 92/88; 277/DIG. 7

[58] Field of Search ..... 92/88, 85 B, 137; 277/DIG. 7

[56] References Cited

U.S. PATENT DOCUMENTS

| | | | |
|---|---|---|---|
| 4,273,031 | 6/1981 | Hannon | 92/88 |
| 4,373,427 | 2/1983 | Garlapaty et al. | 92/88 |
| 4,838,147 | 6/1989 | Grishchenko | 92/88 |
| 4,991,494 | 2/1991 | Migliori | 92/88 |
| 5,245,910 | 9/1993 | Drittel . | |

*Primary Examiner*—Hoang Nguyen
*Attorney, Agent, or Firm*—Watson Cole Stevens Davis, P.L.L.C.

[57] ABSTRACT

A rodless pressure cylinder (1) has a cylinder housing (2) with a longitudinal slot (6) through it and is closed on each end by a cylinder cap (12). The longitudinal slot (6) is sealed on its inside by an inner sealing strip (7) and as necessary is also covered on its outside by an outer sealing strip (8). The provided sealing strips (7,8) are fastened by special clamping elements (11), in or on the longitudinal slot (6). The cylinder caps (12) are provided on each side with connectors for the feed and discharge of pressure medium. Since the sealing strips (7,8) are fastened by the special clamping elements (11) independent of the caps (12), the cylinder caps (12) can be installed in various positions on the cylinder housing (2). They are constructed rotationally symmetrical for this purpose, which is particularly valid for the pressure medium channels in the interior of the cylinder caps (12). The cylinder caps (12) can therefore be mounted on the pressure cylinder (1), respectively such that the respective connector (17) for the pressure medium lies in a sufficiently accessible position of the mounted pressure cylinder (1).

7 Claims, 3 Drawing Sheets

RODLESS PRESSURE CYLINDER

BACKGROUND OF THE INVENTION

1. Field of the Invention

The invention pertains to a rodless pressure cylinder with a cylinder housing which is provided with a longitudinal slot extending along its entire length and which has a cylindrical interior in which a longitudinally movable drive piston is arranged. A lateral attachment extends from this piston outwardly through the longitudinal slot. Cylinder caps are provided at the ends of the cylinder housing for enclosing the cylindrical interior thereof and a coupling is provided on the outside for the feed and discharge of the pressure medium which actuates the drive piston. The longitudinal slot is sealed by an interior sealing strip in the interior of the cylinder housing, which is lifted from the longitudinal slot only in the region of the attachment and penetrates through a guide channel in the drive piston. The slot is always sealed from the outside with an additional outer sealing strip which is fastened onto the outside of the cylinder housing over the longitudinal slot at its ends with clamping elements separated from the cylinder caps.

2. The Prior Art

A rodless pressure cylinder of the foregoing type of construction is disclosed in U.S. Pat. No. 5,245,910. The outer sealing strip which covers the longitudinal slot on the outside of the cylinder housing is anchored on both sides in this known apparatus by clamping elements separated from the cylinder caps on each side, the clamping elements being fastened onto the cylinder housing with two screws and each including a threaded hole for the connection of a pressure line. The threaded hole leads to the gap between the outer and inner sealing strips which extend up to the caps where a sealing is established between the clamping element holding the outer sealing strip and the inner sealing strip on the longitudinal slot. The longitudinal slot is thus sealed so that it is possible to produce a vacuum in the gap between the two sealing strips or an overpressure against the ambient pressure surrounding the pressure cylinder. In this way a leaking of pressure out of the pressure cylinder into the surrounding space or from the surrounding space into the cylinder is avoided, for example if the pressure cylinder is used in a pure or in an aggressive atmosphere. The fastening of the ends of the inner sealing strip is not described in this patent. Since the inner sealing strip is, however, exposed to a tensile load in its longitudinal direction during the operation of the pressure cylinder and the interior as well as the gap between the two sealing strips must be sealed, it must extend up to the two cylinder caps and be anchored to the cylinder housing with an elastic seal in form-locked fashion and not merely tensionally. It must therefore be presumed that the inner sealing strip is fastened to the cylinder housing in a conventional fashion by the cylinder cap.

Pressure cylinders, pneumatic or also hydraulic cylinders, require air attachments for the feed of the pressure medium actuating the working piston of the cylinder, such attachments being enabled by means of threads of various sizes for the incorporation of screwed hose couplings or also of so-called plug connectors. The connectors lie in general perpendicularly to the axis of the pressure cylinder extending horizontally between the enclosure caps of the cylinder. During use of the pressure cylinder it is often required to have the connectors feed towards the other side or towards the bottom, perhaps also upwardly, since the placement relationship requires this during mounting of the pressure cylinder.

In rod-piston cylinders having the driving force centered along the piston shaft, the prior position of the attachment on the pressure cylinder at production is not important since the cylinder is built rotationally symmetrical and a user is in a position to locate the attachment during mounting of the pressure cylinder by turning it about its axis to wherever he pleases. However, the construction forms of known cylinders with no drive rod known make the simple rotation of the cylinder impossible, since the force output does not result centrally at the end of the cylinder, but rather laterally on the cylinder through the longitudinal slot. The spatial positioning of the pressure cylinder is therefore determined by the position of the connectors for driving the equipment to be driven.

Up until now, this problem has been solved in that for each rodless pressure cylinder, various cylinder caps have been offered with connectors lying at various positions. Another solution of the problem consists of a so-called universal cap, which has three equal threaded connectors. The unused connectors must be closed by means of plugs.

The object of improving the known rodless cylinder of the type described above such that the connectors for the feed and discharge of the pressure medium can be provided off of the cylinder caps on desired sides of the cylinder in a simple way and without changing the caps establishes the basis of this invention.

SUMMARY OF THE INVENTION

The invention provides the means of attaining this object in that the inner seal strip is also anchored at each of its ends with a clamping element separated from the cylinder caps in or on the longitudinal slot and the two cylinder caps can be fastened onto the cylinder housing in various positions across from one another in the plane of the cylinder cap, and that the channels in the two cylinder caps transferring the pressure medium are constructed rotationally symmetrically in the transfer region between the cylinder cap and the neighboring component of the cylinder housing. The invention is really quite simple; however, it has not been recognized by practitioners since the cylinder caps in rodless cylinders, contrary to the pressure cylinders with drive pistons, are not built with rotational symmetry. As is commonly known, the seal strips sealing the inside of the longitudinal slot are clamped solid and fastened by means of the cylinder cap in the slot region with rodless cylinders. On this basis, a permanent positioning of the cylinder cap in relation to the cylinder housing is prescribed, so that a simple turning of the cylinder cap to another position seemed impossible. The separation of the fastening of the inner seal strip from the cylinder caps, first suggested by this invention, creates the fundamental prerequisite to enable these caps to be positioned in other positions by rotation. To accomplish this, it is necessary that all pressure medium channels and holes in the caps be arranged rotationally symmetric in order to ensure the required line connections in all possible installation positions. The invention makes it possible in any case to be able to choose separately the position of the connector for the feed and discharge of the pressure medium actuating the cylinder for each cylinder cap, so that the connectors can be laid out in a simple way in a location which is always sufficiently accessible for the installation as well as advantageous for the subsequent operation of the cylinder.

The clamping elements with which the sealing strips are fastened on or in the longitudinal slot of the cylinder housing can be installed in the vicinity of the end of the cylinder housing in the longitudinal slot and be held to the walls of the longitudinal slot using an expanding setscrew with a wedging effect. The inside seal strip, which seals the longitudinal slot in the region of the cylinder space subject to pressure, can therefore be fastened to the clamping element form-locked while an outer sealing strip which seals the longitudinal slot from the outside can be tensionally locked to the clamping element. These clamping elements lie in a relatively narrow dead zone directly at the end of the cylinder housing. It is in this same zone in which the airtight sealing of the cylinder housing results. Each clamping element presses against the walls of the longitudinal slot by means of a wedging effect and effects a guaranteed anchoring of the inner as well as the outer sealing strip. Since the clamping element is axially displaceable in the longitudinal slot, the strip tension can be simply adjusted to the respective requirements.

In a preferred embodiment of the invention, the cylinder cap, constructed preferably with multi-sided, for example rectangular or square, cross section, can be pressed onto the cylinder housing by hold-down bolts arranged symmetric to the center running parallel to the axis of the cylinder housing. In this embodiment, it is possible in a simple way to rotate the two cylinder caps after loosening of the hold-down bolts at an angle of 90° in its plane so that the connector for the pressure medium can be provided in four different spatial positions. This embodiment has the added advantage that it requires no substantial changes of the previous construction of the rodless cylinder.

In another variation of the cylinder according to the invention, the cylinder cap can be freely rotated on a cylinder surface centralized to the cylinder housing and coaxial to the cylinder surface. It is then possible to install the two cylinder caps with the connectors for the pressure medium in any desired spatial position. A further development of this embodiment provides that the cylinder caps are fastened to the cylinder housing by a carriage gripping them and which rotates relative to them. Hold-down bolts grip the carriage which press the cylinder caps onto the cylinder housing.

In a further refinement of the invention, this can be used in a beneficial way as well in a rodless pressure cylinder which is provided with an end-position dampening for the drive piston. The end-position dampening consists, similarly to known embodiments, of dampening taps on the ends of the cylinder housing extending into it in the axial direction with a central channel for the feed and discharge of the pressure medium. The dampening taps work together with dampening cylinders on the sides of the drive piston. The central channel is closed off during penetration of a dampening tap and at least one dampening channel is provided lateral to each dampening tap which opens to the pressure medium connection through a throttle adjustable with a dampening screw.

According to the invention, in a pressure cylinder with end-position dampening, the dampening screw for the adjustment of the throttle is arranged on the same side of the cap as the pressure medium connector, and is direct&d with its axis approximately in the same direction as the pressure medium connector. A connecting channel extending rotationally symmetrically in the cylinder cap is arranged between the dampening channel and the throttle. In this embodiment of the pressure medium cylinder, the dampening screw is also placed in the same location with the connector for the feed and discharge of the pressure medium so that the dampening screw lies at a position for good access and simple dampening adjustment.

Further features and advantages of the invention will be understood by reference to the attached drawings taken in conjunction with the following description.

DETAILED DESCRIPTION OF THE PREFERRED EMBODIMENTS

Figure 1:
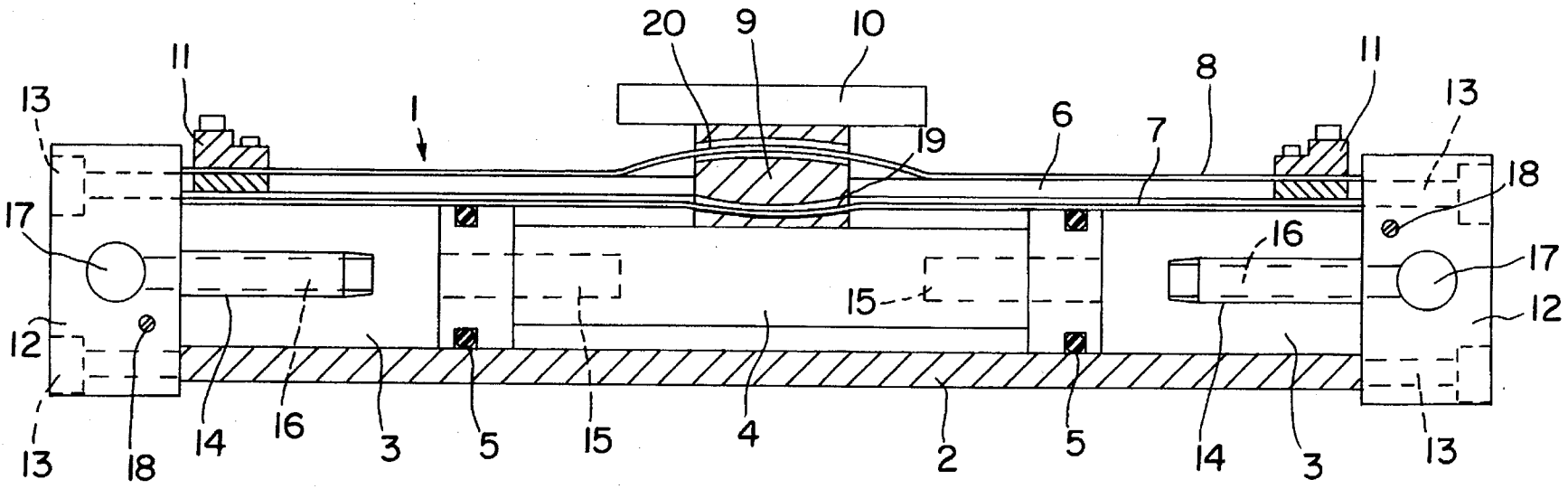
FIG. 1 shows a partially sectioned side view through a rodless pressure cylinder according to a first embodiment of the invention.

In all embodiments of the invention the pressure cylinder 1 consists of a cylinder housing 2 which has a cylindrical interior 3 in which a drive piston 4 is moveable. The drive piston 4 is sealed in the cylindrical interior 3 with gaskets 5 on its ends and divides this interior into two independent (unconnected) pressure spaces on both sides of the drive piston 4.

The cylinder housing 2 is provided with a longitudinal slot 6 passing therethrough over its entire length. This is sealed in the region of the two pressure spaces of the cylindrical interior 3 with sealing strips, i.e., by means of an inner sealing strip 7 and an outer sealing strip 8, which essentially seals the longitudinal slot 6 from the outside. A lateral attachment 9 is fastened to the drive piston 4 according to FIG. 1, which leads through the longitudinal slot 6 out of the cylinder housing 2, and in the embodiment of FIG. 1 terminates with an attachment flange 10. The driving force of the pressure medium cylinder 1 is received by this attachment flange 10 and, via coupling of the attachment flange with a machine part to be driven by the pressure cylinder 1, is conveyed to the machine part.

As is seen from FIG. 1, the two sealing strips, i.e., the inner sealing strip 7 and the outer sealing strip 8, are fastened at each end of the cylinder housing 2 with clamping elements 11 on or in the longitudinal slot 6. The clamping elements 11 are positioned immediately at the edge of cylinder caps 12, which are seal-pressed onto the cylinder housing 2 with four hold-down bolts 13. A dampening tap 14 extends from each cylinder cap 12 towards the drive piston 4 in the cylindrical interior 3 of the cylinder housing 2. A dampening cylinder 15 is provided in each of the two ends of the drive piston 4, which both work together with the dampening taps 14. These are made hollow and are connected by a central channel 16 with the respective connector 17 for the pressure medium driving the drive piston 4. Dampening screws 18 are installed laterally next to the connectors 17 in the two caps 12, which serve to adjust the throttling of a dampening apparatus for end-position dampening.

Figure 2:
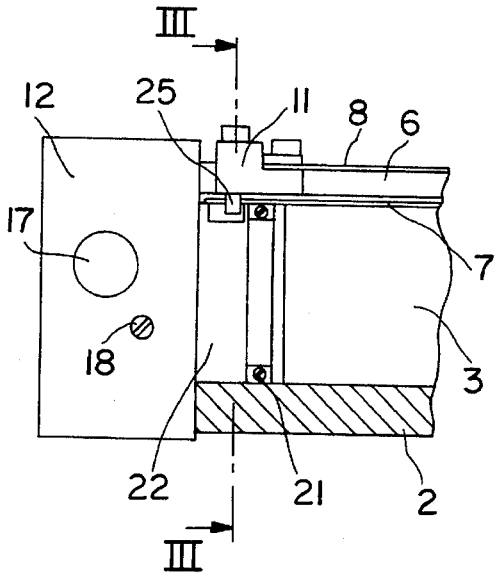
FIG. 2 shows, on an enlarged scale, a sectional representation of one end of the pressure cylinder of FIG. 1.
Figure 3:
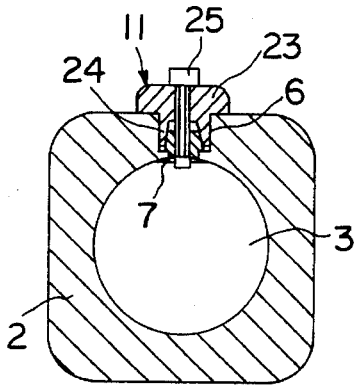
FIG. 3 shows a section according to line III—III in FIG. 2.
Figure 2A:
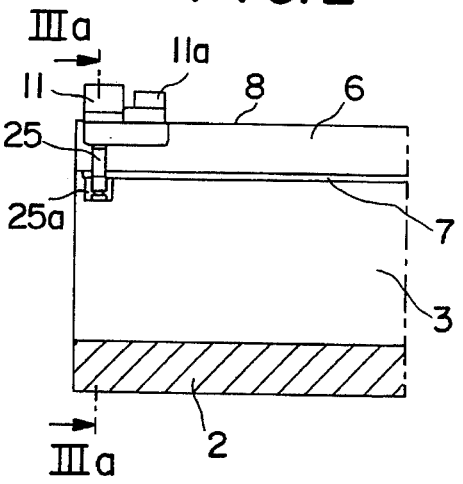
FIG. 2*a* shows a somewhat different embodiment compared to FIG. 2 of the cylinder housing without the cylinder cap.
Figure 3A:
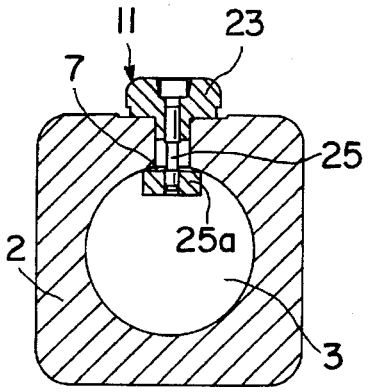
FIG. 3*a* shows a section analogous to FIG. 3 according to the line IIIa—IIIa in FIG. 2*a*.

It can be seen from FIG. 1 that the two cylindrical interiors 3 of the cylinder housing 2 between the respective cylinder cap 12 and the gasket 5 of the drive piston 4 are sealed by the inner sealing strip 7. In the region of the radial attachment 9 of the drive piston 4, the inner sealing strip 7 penetrates a guide channel 19 and the outer sealing strip 8 is fed through a guide channel 20 equally provided in the radial attachment 9. The respective tension of the two sealing strips 7 and 8 can be regulated by the clamping elements 11 at their ends, which can be correspondingly displaced in the longitudinal slot As is seen in FIG. 2, the clamping elements 11 lie essentially in a dead zone between the end of the cylinder housing 2 and a gasket 21, from the standpoint of pressure impingement. The gasket is provided on a cylindrical attachment 22 which extends in from the cap 12 into the cylindrical interior 3. The essential construction of the clamping elements 11 is seen in FIGS. 3 and 3*a*. Each of these consist according to FIG. 3 of a housing 23 and a clamping key 24 which is drawn into a notched recess of the housing 23 by means of a clamping screw 25 and which spreads the housing and fastens it against the side walls of the longitudinal slot 6. In the embodiment according to FIGS. 2*a* and 3*a*, the housing 23 of each clamping element 11 is fastened by means of a clamping screw 25 and a nut 25*a* into the longitudinal slot 6.

In both embodiments the interior sealing strip 7 extends up to the ends of the cylinder housing 2 and is held form-locked according to FIGS. 2 and 3 by the bolt of the clamping screw 25, through an opening in the sealing strip. In the embodiment of FIGS. 2*a* and 3*a*, the ends of the inner sealing strip are clamped against the longitudinal slot 6 additionally with the nut 25*a* of the clamping screw 25. The outer sealing strip 8 is somewhat shorter in all examples than the inner sealing strip 7 and is held in place by a special holding arrangement 11*a* on the clamping element 11 or between this and the cylinder housing 2.

Figure 4:
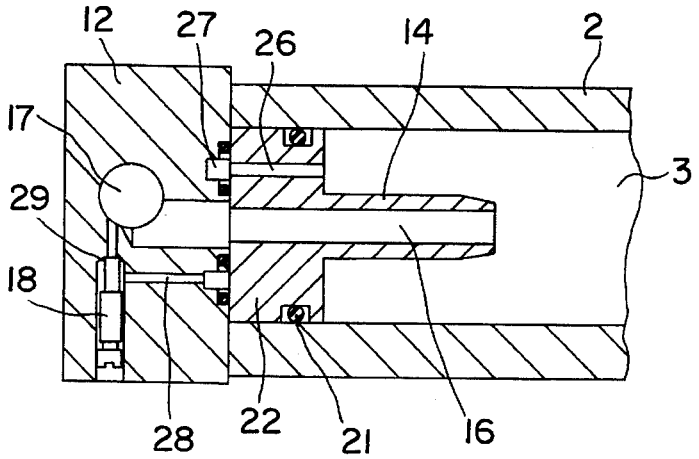
FIG. 4 shows an end of a pressure cylinder according to another embodiment in axial elevation.

The principle construction of the previous dampening apparatus can be seen in FIG. 4. Here, also, the cylinder housing 2 is closed with caps 12 containing hold-down bolts, not shown, on its ends. An attachment 22 joins with the illustrated cap 12, in this case separate from the cap 12, which extends into the cylindrical interior 3 and seals it with gasket 21. A dampening tap 14 extends from the attachment 22, which works together with a dampening cylinder of the drive piston, both not shown. As in the other examples, the dampening taps 14 have a central channel 16, which is in communication with the connector 17. Parallel to the central channel 16 of the dampening tap, a dampening channel 26 penetrates the attachment 22 and connects the cylindrical interior 3 with a connecting channel 27 in the cap 12. This connecting channel 27 extends in the cap 12 rotationally symmetrically and leads to a throttle 29 through a connecting hole 28 provided in the cap 12, which can be adjusted by means of the dampening screw 18. The throttle 29 is tied to the connector 17.

Figure 5:
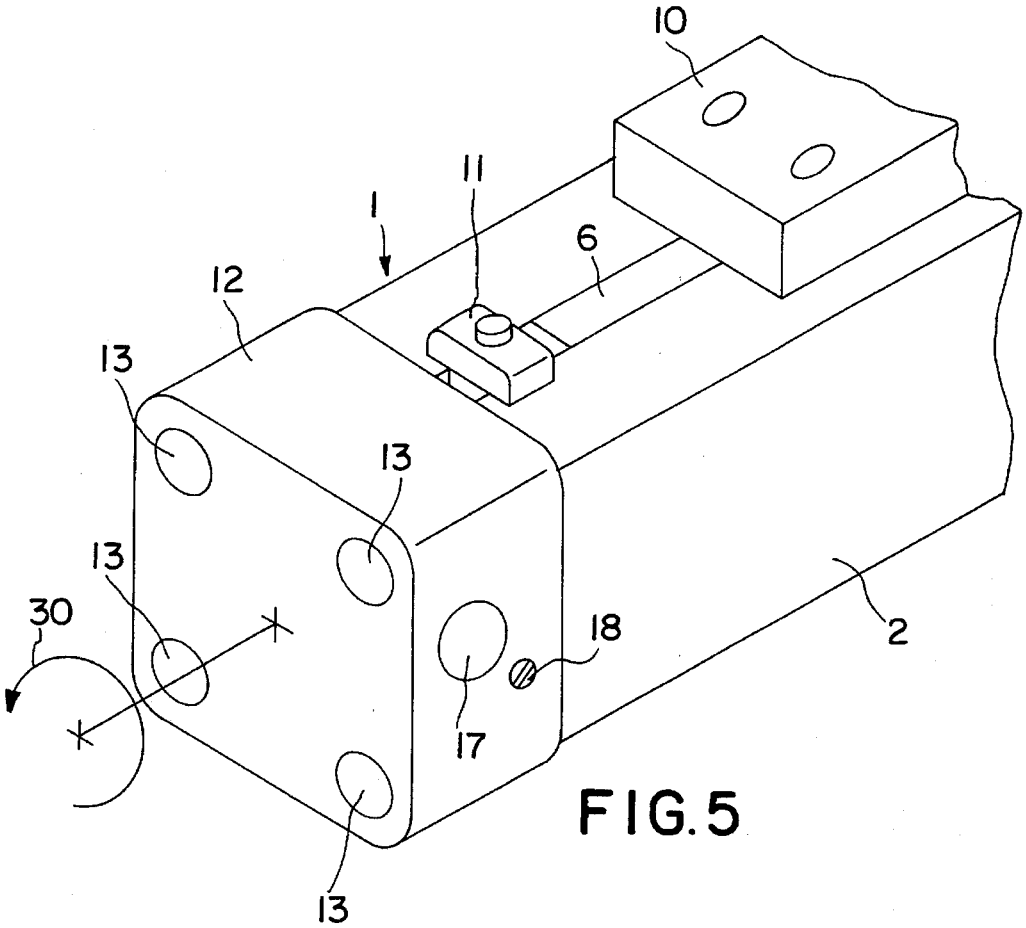
FIG. 5 shows a perspective view of the end of the cylinder.

With the use of the schematic representation in FIG. 5, the means of functioning of the invention can be illustrated. The cap 12 represented in FIG. 5 is constructed as a square and attached to the cylinder housing 2 with the help of four parallel hold-down bolts 13, arranged symmetrically with respect to the center (only schematically depicted). The connector 17 for the feed and discharge of the pressure medium activating the pressure cylinder 1 and the dampening screw 18 for the end-position dampening is located on the illustrated front side of the cap 12. The longitudinal slot 6 lies above and in the middle of the cylinder housing 2, where the connecting flange 10 for the force transfer to the apparatus to be driven is also provided. The position of the connecting flange 10 and thus also the cylinder housing 2 is prescribed by this force transfer attachment.

In order to shift the pressure medium connector 17, it is merely necessary to loosen the four screws 13, remove the cap 12 from the cylinder housing 2, and, for example, to turn 90° in the direction of the arrow 30 or in the opposite direction, again insert the four hold-down screws 13 and fasten it again with their help to the cylinder housing 2. If the cap 12 is turned 90° in the direction of the arrow 30, the connector 17 and the dampening screw 18 are located on the top side of the pressure cylinder 1. With a rotation of 180°, the connector 17 and the dampening screw 18 lie on the (hidden) backside of the pressure cylinder 1. By a 90° rotation of the cap 12 opposite to the direction of the arrow 30, the connector 17 and the dampening screw 18 lie on the lower side of the pressure cylinder 1.

The connector 17 for the pressure medium feed and with this also the dampening screw 18 can be quickly and easily shifted to the most accessible side of the pressure cylinder 1. This is made possible in the first place in that the cap 12 according to the invention is no longer attached to the cylinder housing 2 for the fastening of the sealing strips on or in the longitudinal slot 6, but rather in that individual clamping elements 11 are used for this purpose.

From the representation in FIG. 4, it can be seen that these rotations of the cap and the connector locations are also possible in embodiments which are provided with a dampening apparatus. This is traced back to the rotationally symmetrically constructed connection channel 27, which ensures in every position of the cap 12 that the dampening channel 26 is connected to the connection hole 28 leading to the throttle 29. If the dampening tap 14 proceeds into the dampening cylinder 15 in the drive piston 4 and the central channel 16 essentially is closed, a compression of the pressure medium results out of the annular space around the dampening taps 14 through the dampening channel 26, the connection channel 27, and the connecting hole 28 to the throttle 29 and from this to the connector 17. The cap 12 can thus be shifted in any desired position with this embodiment.

Further, it is not difficult to see that, in the pressure cylinder according to the invention, the cap 12 can be constructed not only as a rectangle, but also square, or it can have entirely any desired multi-angular form. It is merely necessary that the cap not be attached for the tensile fastening of the sealing strips and that the hold-down bolts 13, as well as the channel path on the interior of the cap, are arranged symmetric to the center which represents the base requirements for the ability to turn the cap in an orderly fashion. Finally, the cap can also be constructed cylindrically.

Figure 6:
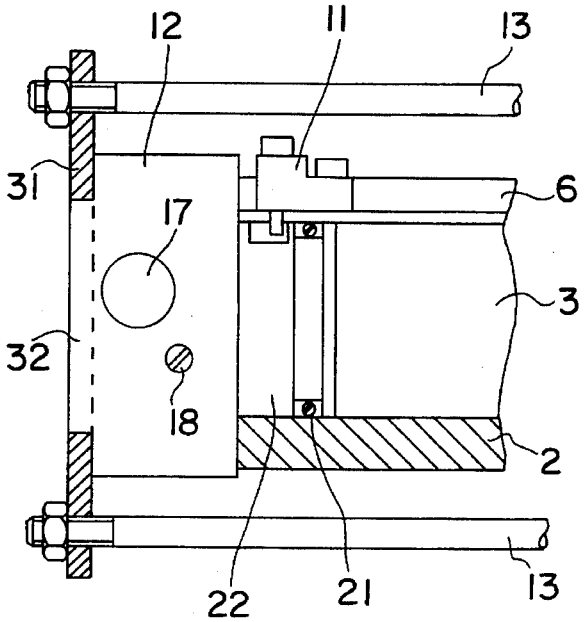
FIG. 6 shows the cylinder end of another embodiment in a partially sectioned side view.

Independent of the outer geometrical form of the cap, it is possible to shift the cap not only stepwise, but also continuously rotatable. An embodiment of this variation of the invention is shown in FIG. 6. The cap 12 is cylindrically constructed and extends into the cylindrical interior space 3 with a cylindrical attachment 22, which is sealed against the interior with the help of a gasket 21. The two sealing strips not represented are also fastened here with clamping elements 11. The two caps themselves are fastened onto the cylinder housing 2 by means of hold-down bolts 13, whereby the number of the hold-down bolts 13, their location and form of construction are arbitrarily chosen. Further, the function of the hold-down bolts can be carried out by parts of the machine stand into which the cylinder is installed as a whole.

In FIG. 6, it follows that the hold-down bolts 13 grip a carrier frame 31 provided behind the cap 12, in which the cap 12 can be rotated as mounted by means of a centrally extending cylindrical projection 32. By loosening the hold-down bolts 13 the cap 12 can be rotated continuously in this manifestation example about its axis in both directions, so that the connector 17 for the pressure medium together with the dampening screw 18 can be shifted to any desired position continuously. The prerequisite here is again that the sealing strips not be fastened by means of the cap 12, but by individual clamping elements 11 and that the channel lines in the interior of the cap 12 be constructed rotationally symmetrical.

Lastly, it is especially an advantage for the user to provide for the possibility of mounting the cap in horizontal or vertical orientation, thus in right-angled positions to the machine stand, while the lateral connector with the connecting flange can be arranged in an inclined form, relatively, between 0° and 90°, according to the starting view point. This inclined drive position can, as a rule, contribute to the solution of difficult position relationships or force connections.

I claim:

1. A rodless pressure cylinder (1) with a cylinder housing (2) having a longitudinal slot (6) over its entire length and which has a cylindrical interior (3), a drive piston (4) positioned in the cylinder and longitudinally moveable therewithin, a lateral attachment (9) extending from the drive piston through the longitudinal slot (6) to the outside for force transfer, cylinder caps (12) enclosing the cylindrical interior (3) of the cylinder housing (2) on its ends, each said cylinder cap including an attachment (17) on its outside for the feed and discharge of the pressure medium which actuates the drive piston (4), clamping elements (11) separated from the cylinder caps (12), an inner sealing strip (7) in the interior of the cylinder housing (2) for sealing the longitudinal slot and which is lifted from the longitudinal slot (6) only in the region of the attachment (9), said inner sealing strip penetrating through a guide channel (19) in the drive piston (4), an outer sealing strip (8) which is fastened onto the outside of the cylinder housing (2) over the longitudinal slot (6) at its ends, the inner sealing strip (7) being anchored at each end thereof with said clamping element (11) in or on the longitudinal slot (6), said two cylinder caps (12) being fastened in various rotated positions across from one another in a plane of the cylinder cap (12), the channels transferring the pressure medium in the two cylinder caps (12) being arranged rotationally symmetric in the transfer region between the cylinder cap and an adjacent component part of the cylinder housing (2).

2. A pressure cylinder according to claim 1, wherein the clamping elements (11) are installed in the longitudinal slot (6) in the vicinity of the ends of the cylinder housing (2) and are fastened to the walls of the longitudinal slot (6) by clamping screws (25) which spread the clamping elements (11) by means of wedging action.

3. A pressure cylinder according to claim 1, wherein the inner sealing strip (7) is fastened form-locked, and the outer sealing strip (8) is fastened tensionally to the clamping elements (11).

4. A pressure cylinder according to claim 1, wherein the cylinder caps (12), which are constructed with multi-sided cross section, are pressed onto the cylinder housing (2) by hold-down bolts (13) arranged symmetrically to a center, extending parallel to the axis of the cylinder housing (2).

5. A pressure cylinder according to claim 1, wherein the cylinder caps (12) can be freely rotated centrally on a cylindrical surface of the cylinder housing (2) and coaxially to the cylindrical surface.

6. A pressure cylinder according to claim 5, wherein the cylinder caps (12) are fastened to the cylinder housing (2) by means of a carriage (31) gripping them and which turns relative to them, hold-down bolts (13) gripping this carriage which presses the cylinder caps (12) to the cylinder housing (2).

7. A pressure cylinder according to claim 1, including an end-position dampening means for the drive piston (4) which consists of dampening taps (14) extending into the cylinder housing (2) on the ends in the axial direction with a central channel (16) for the feed and discharge of the pressure medium, said taps working together with dampening cylinders (15) on the ends of the drive piston (4), said central channel (16) being closed off during penetration of a dampening tap (14) and at least one dampening channel (26) is provided lateral to each dampening tap (14) which opens to the pressure medium connection (17) through a throttle (29) adjustable with a dampening screw (18), the dampening screw (18) for the adjustment of the throttle (29) being arranged on the same side of the cap (12) as the pressure medium connector (17), and directed with its axis approximately in the same direction as the pressure medium connector (17), and a connecting channel (27) extending rotationally symmetrically in the cylinder cap (12) is arranged between the dampening channel (26) and the throttle (29), concentrically surrounding the central hole (16).

* * * * *